US006122940A

United States Patent [19]

Pezzoli

[11] Patent Number: 6,122,940

[45] Date of Patent: Sep. 26, 2000

[54] PROCESS FOR THE PRODUCING OF WARP-KNITTED FABRICS PRODUCED FROM DISCONTINUOUS FIBRE YARNS AND APPARATUS FOR THE PRODUCTION THEREOF

[75] Inventor: Luigi Pezzoli, Cene, Italy

[73] Assignee: SITIP S.p.A., Cene, Italy

[21] Appl. No.: 09/051,820

[22] PCT Filed: Mar. 19, 1997

[86] PCT No.: PCT/EP97/01387

§ 371 Date: Apr. 17, 1998

§ 102(e) Date: Apr. 17, 1998

[87] PCT Pub. No.: WO98/27255

PCT Pub. Date: Jun. 25, 1998

[30] Foreign Application Priority Data

Dec. 18, 1996 [IT] Italy ..... MI96A2647

[51] Int. Cl.[7] ..... D04B 35/32

[52] U.S. Cl. ..... 66/168; 66/203

[58] Field of Search ..... 66/83, 84 R, 209, 66/168, 192, 203

[56] References Cited

U.S. PATENT DOCUMENTS

| | | | |
|---|---|---|---|
| 3,378,998 | 4/1968 | Shackelford | 66/168 |
| 3,461,693 | 8/1969 | Klaeui | 66/168 |
| 3,978,691 | 9/1976 | Schmid | 66/168 |
| 4,487,040 | 12/1984 | Patel et al. . | |

FOREIGN PATENT DOCUMENTS

| | | | |
|---|---|---|---|
| 2256729 | 6/1974 | Germany . | |
| 2410642 | 6/1976 | Germany | 66/168 |
| 1110607 | 4/1968 | United Kingdom . | |

OTHER PUBLICATIONS

Melliand Textilberichte Intern. –vol. 65 n. 10 Oct. 1984.

*Primary Examiner*—Danny Worrell
*Attorney, Agent, or Firm*—Collard & Roe, P.C.

[57] ABSTRACT

Process for the production of warp-knitted fabrics realized from discontinuous natural or synthetic yarns constituted of at least 50% of discontinuous fiber yarns, or yarns constituted of at least 50% discontinuous fiber, comprising the healding of the yarn in an air current, warp-knitted fabrics from discontinuous fibers so obtained, and apparatus for the production thereof.

11 Claims, 1 Drawing Sheet

Figure 1:
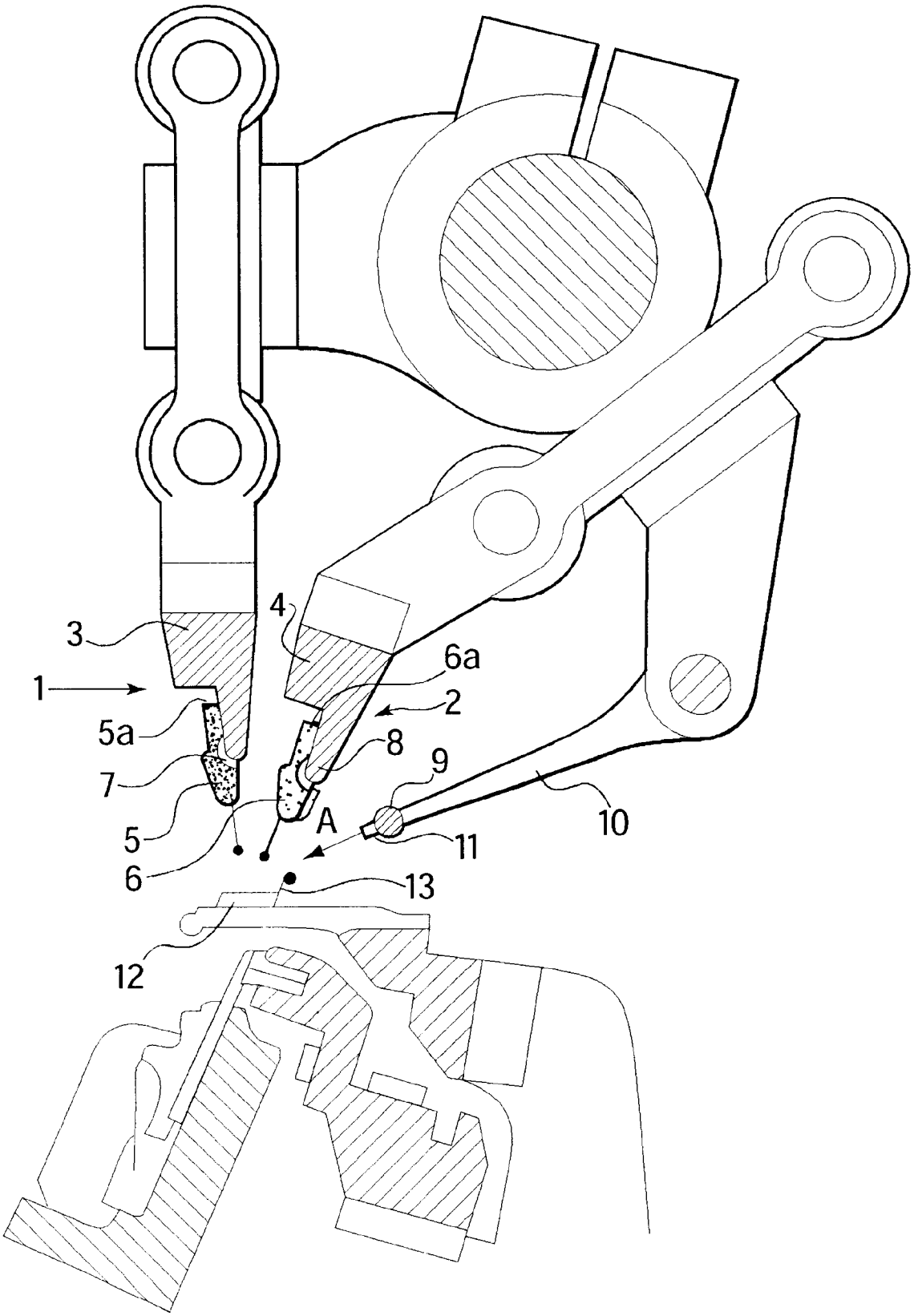

PROCESS FOR THE PRODUCING OF WARP-KNITTED FABRICS PRODUCED FROM DISCONTINUOUS FIBRE YARNS AND APPARATUS FOR THE PRODUCTION THEREOF

DESCRIPTION

The present invention relates to a process for the production of warp-knitted fabrics, constituted from at least 50% by discontinuous fiber yarn. The invention also relates to warp-knitted fabrics comprising at least 50% discontinuous fiber yarn, as well as the apparatus for the production thereof. As is known, knitted fabrics may be obtained according to various production processes, in particular by knitting on circular knitting looms, for instance for the production of woman stockings, by knitting on Raschel looms to obtain open-work fabrics, curtains, laces, patterned fabrics in general, and by knitting on warp-knitting looms for warp-knitted fabrics, to obtain fabrics intended for the technical-industrial field, furniture and upholstery, footwear, the medical field, clothing and the like.

As is also known, with the working processes on circular looms and with those on Raschel type loom, it is possible to utilize both yarns constituted of continuous fibers such as nylon, polyester and the like obtained with chemical processes, and yarns constituted of discontinuous fibers obtained by means of mechanical spinning processes starting from flock and staple fibers or in any case from short and fragmented fibers, such as cotton, wool, polyesters, etc., as well as wool or cotton wastes and the like.

With the working processes on warp-knitting looms for warp-knitted fabrics, it is possible to produce a very thin knitting with very high working speed, and therefore with very high yields, but, as is known, by this type of working it is possible to use only continuous fiber yarns obtained from chemical processes, or mixed yarns prevailingly composed, for at least 50%, of continuous fibers.

Discontinuous yarns, more hairy and less resistant than the continuous ones, have proved unfit for being worked according to this type of working, as frequent interruptions occur during the working due to loom stopping, yarn breaking, etc. The same drawbacks take place, as is known, with mixed yarns, when the content of discontinuous yarns is higher than 50%.

Object of the present invention is to provide a process for the production of warp-knitted fabrics, with yarns substantially and prevailingly constituted of discontinuous fibers, i.e. having a content of 50% to 100% of discontinuous fibers, using warp-knitting looms for warp-knitted fabrics having a plurality of reeds, high speed and high yield.

Another object of the invention is to realize and provide fabrics to be used in technical-industrial fields, furniture, upholstery, footwear, in health-sanitary field, for clothing and the like, having a high thickness, produced from prevailingly discontinuous fibers, in a quantity in excess of 50%, using high speed, high yield warp-knitting looms of the tricot type.

Still a further object of the invention is to realize an apparatus suitable for the realization of a process of warp-knitting with discontinuous or prevailingly discontinuous yarns.

These and still other objects and related advantages which will appear from the following description are achieved by a process for the production of warp-knitted fabrics produced on looms having a plurality of bars. The process comprises an unwinding stage of the yarn from the yarn supporting and housing beams, a yarn collection and winding stage on winding tubes synchronized with the stage of yarn unwinding, and a knitting stage of the yarn by high speed axial movements of a plurality of reeds placed close to one another. The knitting stage is realized in the presence of a continuous or intermittent current of a gas circulating in correspondence of the reeds, suitable to remove powder particles and/or fiber fragments from the surface of the reeds.

As is known, the reeds are constituted of a plurality of sinkers located next to one another on a bar along the whole reed, and act cumulatively in correlation with the needles-carrying bar. Particularly, the needles are advantageously compound needles.

According to this invention, it has been found that by operating in a gas current, it is possible to work on high speed warp-knitting looms yarns comprising more than 50% discontinuous fibers and even constituted from 100% discontinuous fibers, without giving rise to drawbacks such as loom stopping, and ensuring production continuity and economy. It has been found that, according to the process subject matter of this invention, it is also possible to work on high speed warp-knitting looms also yarns constituted from discontinuous natural and synthetic yarns, and blends with more than 50% discontinuous fibers.

Always according to the present invention, the gas current is obtained through continuous or interrupted inlet of a gas jet from a special nozzle, under a pressure sufficient to reach and remove the powder particles and/or fiber fragments from the surfaces of the reeds.

According to an alternative embodiment of the present invention, the gas current is obtained by creating a suction near the surfaces of the reeds.

Preferably, the gas is air or any other gas or gas mixes, such as nitrogen, carbon dioxide and the like, possibly on prior drying of the same.

According to the process subject matter of the present invention, it is possible to obtain warp-knitted fabrics with discontinuous yarns or yarns comprising at least 50% discontinuous fibers, realized on warp-knitting looms having a plurality of bars, the fabrics being usable in technical-industrial fields, such as coagulation, coating, resin-coating, lamination and the like, for furniture and upholstery, footwear, the medical field, apparel field and the like.

An apparatus or loom suitable to realize the process according to the present invention, comprises:

- a plurality of yarn supporting and housing beams and the related mechanism for the unwinding of the yarn;
- at least a fabric collection and winding tube and the related winding mechanism synchronised with the yarn unwinding;
- a plurality of reeds constituted of several sinkers located next to one another along a bar, the sinkers being provided with a groove or cavity suitable to allow the passing and downwards fall of the powder and/or fiber fragments deposited on the surface of the reeds;
- at least a blowing duct conveying a pressurized gas, positioned near said reeds and provided with a plurality of holes or nozzles so oriented as to direct a flow of the gas on the surface of the reeds and to remove the powder, causing it to fall under the apparatus.

The present invention is described hereafter with reference to the attached drawing provided only by way of non limitative example, wherein:

FIG. 1 shows a schematic section of the detail of an apparatus according to the invention, of the type comprising two reeds or bars.

With reference to such FIGURE, the apparatus according to the invention comprises a plurality of yarn supporting and housing beams and at least a fabric winding beam, not shown in the FIGURE, being of a conventional type, and the two reeds 1 and 2, constituted of several sinkers 5 and 6 located on bars 3 and 4 respectively. Sinkers are provided with cavities or grooves 7 and 8 between the sinker body and the bar.

Through the blowing duct 9, substantially constituted of a hollow bar supported by arm 10, pressurized air is blown according to arrow A, through the nozzles or holes 11, towards top 5*a*, 6*a* of the sinker, when the corresponding reed is in the knitting stage under nozzles 11. The air blown according to A causes the powder and/or fiber fragments to fall under bar 12 carrying fallers 13, and besides keeps cavities 7 and 8 clean, so that sinkers need not bearing a flexure due to infiltration of impurities, keeping in this way reeds perfectly clean and preventing any jamming and subsequent stop of the loom. Besides, always according to the invention, the warp-knitting loom has free sides with beams loads without central support. For instance, such free sides, with three beam loads with flange diameter of 40 inch. each, are fit for housing two fractions per discontinuous yarn knitting with flange diameter of 1000 mm, and also knitting beams with continuous yarn with flange diameter of 30 inc. The free realization of sides allows to place as one wishes the blowing duct for crossbeam and healding gears, even of serial type.

The advantages reached thanks to the process and the related apparatus according to the present invention comprise the production of a new high thickness fabric from discontinuous fibers or prevailingly discontinuous fibers, having special technical characteristics, in particular elastic and high resistance properties, that at present can be obtained only with continuous fiber yarns, and special touch properties; besides, there is an increase in yield, as fabric production with warp-knitting looms is equal to about six times the one obtained with weaving-looms according to the known art. Another advantage reached with the realization of the process and apparatus according to this invention is due to the fact that, by using discontinuous yarns, it is possible to utilize the same fabric supporting and housing beams, fraction and/or section warped, which are conventionally used in the other types of weaving instead of the beams usually used for warp-knitting with continuous yarn. As is known, the latter which can also be used for carrying out the process and the apparatus according to the present invention, are more complicated and expensive that the beams usually employed for the other types of looms. In fact, the beams used for continuous yarns utilized for warp-knitting are provided, as is known, with end flanges that are conical insidewards, and besides they are much more strong and heavy that those used for the other types of weaving. Besides, by standardizing formats and characteristics of beams, these become interchangeable with one another, with obvious and remarkable advantages for the running of the apparatuses, stock and spare part keeping, etc.

What is claimed is:

1. A process for the production of warp-knitted fabrics comprising:

(a) providing a knitting loom having a plurality of bars, a plurality of yarn support and housing beams, a winding tube, and a plurality of reeds located next to one another, said reeds comprising a plurality of sinkers with a groove or cavity suitable to allow the passing and downwards fall of debris selected from the group consisting of powder particles and fiber fragments deposited on the surface of the reeds;

(b) unwinding yarn from the yarn support and housing beams in a yarn unwinding stage of the process, said yarn selected from the group consisting of a discontinuous fiber yarn and a yarn constituted of at least 50% discontinuous fibers (c) collectively winding fabric on the winding tube in a collection and winding stage, said collection and winding stage being synchronized with said yarn unwinding stage; and (d) knitting the yarn in a knitting stage by means of high speed axial movements of said reeds, said knitting stage being conducted in the presence of a continuous or intermittent circulating gas suitable to remove the debris from the surface of said reeds.

2. An apparatus for the production of warp-knitted fabrics comprising:

(a) at least one bar;

(b) a plurality of yarn supporting and housing beams;

(c) means for unwinding yarn from said yarn support and housing beams;

(d) at least one fabric collection and winding tube;

(e) means for winding fabric onto said fabric collection and winding tube synchronized with said means for unwinding yarn;

(f) a plurality of reeds comprising several sinkers located next to each other along said bar, said sinkers being provided with a groove or cavity suitable to allow the passing and downwards fall of debris selected from the group consisting of powder and fiber fragments deposited on the surface of the reeds; and (g) at least one blowing duct conveying a pressurized gas, said duct being located near said reeds and provided with a plurality of holes or nozzles oriented so as to direct a flow of said gas on the surface of said reeds to remove the debris by causing the debris to fall under the apparatus.

3. The process according to claim 1, characterized in that the gas current is produced by a continuous or intermittent inlet of a gas jet from a nozzle under a pressure sufficient to reach and remove said debris from the surface of said reeds.

4. The process according to claim 1, characterized in that said gas current is produced by creating a suction near the surface of said reeds or looms.

5. The process according to claim 1, characterized in that said gas is selected from the group consisting of air, nitrogen, carbon dioxide, and mixtures thereof.

6. Apparatus according to claim 3, characterized in that said reeds act cumulatively in correlation with a needles-carrying bar.

7. Apparatus according to claim 6, characterized in that said needles are of the kind compound needles.

8. Apparatus according to claim 2, characterized in that said beams are selected from the group consisting of fraction warped beams and section warped beams.

9. The apparatus according to claim 2, characterized in that said beams are beams commonly used in weaving discontinuous or prevailingly discontinuous yarns.

10. The apparatus according to claim 2, characterized in that said beams are beams commonly used in weaving continuous yarns.

11. Apparatus according to claim 2 wherein the sides of the apparatus are open to accommodate a plurality of beams loaded with yarn without central support.

* * * * *

UNITED STATES PATENT AND TRADEMARK OFFICE

CERTIFICATE OF CORRECTION

PATENT NO. : 6,122,940
DATED : September 26, 2000
INVENTOR(S) : Luigi Pezzoli

It is certified that error appears in the above-identified patent and that said Letters Patent is hereby corrected as shown below:

Column 4, claim 6,
Line 1, please change "claim 3" to -- claim 2 --.

Column 4, claim 7,
Line 2, after the word "are", please delete "of the kind".

Signed and Sealed this

Second Day of April, 2002

*Attest:*

*Attesting Officer*

JAMES E. ROGAN
*Director of the United States Patent and Trademark Office*